US005207785A

United States Patent [19]

Knickerbocker

[11] Patent Number: 5,207,785

[45] Date of Patent: May 4, 1993

[54] PROTECTOR CAP AND WIPER FOR DISPENSER DISCHARGE ORIFICE

[75] Inventor: Michael G. Knickerbocker, Upland, Calif.

[73] Assignee: Calmar Inc., City of Industry, Calif.

[21] Appl. No.: 746,713

[22] Filed: Aug. 19, 1991

[51] Int. Cl.[5] ..... B67D 1/08

[52] U.S. Cl. ..... 222/148; 222/380; 222/514; 239/115

[58] Field of Search ..... 222/148, 321, 213, 407, 222/402.12, 402.13, 514, 518, 380; 239/114, 115, 123, 329, 331, 541, 579

[56] References Cited

U.S. PATENT DOCUMENTS

| | | | |
|---|---|---|---|
| 3,231,150 | 1/1966 | Holm et al. | 222/518 |
| 3,254,677 | 6/1966 | Wakeman | 222/402.12 X |
| 3,378,205 | 4/1968 | Barker | 222/402.12 X |
| 3,587,942 | 6/1971 | Gailitis | 222/514 X |
| 3,680,738 | 8/1972 | Vos et al. | 222/402.12 X |
| 3,752,370 | 8/1973 | Davenport | 222/514 |
| 5,105,988 | 4/1992 | Knickerbocker | 222/148 |

*Primary Examiner*—Andres Kashnikow
*Assistant Examiner*—Philippe Derakshani
*Attorney, Agent, or Firm*—Watson, Cole, Grindle & Watson

[57] ABSTRACT

A finger actuated plunger of a dispenser has a protector cap telescoped over the plunger head for reciprocation independently thereof along the axis of plunger reciprocation. A portion of the cap side wall covers the discharge orifice in the head in a condition of non-use, and the cap side wall has an aperture adjacent such wall portion for alignment with the orifice for uncovering the orifice in a condition of use. A spring extends solely between the head top wall and the cap top wall for resiliently urging the cap into its condition of non-use.

4 Claims, 1 Drawing Sheet

PROTECTOR CAP AND WIPER FOR DISPENSER DISCHARGE ORIFICE

RELATED APPLICATION

This application relates to U.S. Ser. No. 538,735, filed on Jun. 15, 1990, now U.S. Pat. No. 5,105,988, and commonly owned herewith.

BACKGROUND OF THE INVENTION

This invention relates generally to a manually operated dispenser having a reciprocable plunger head containing a discharge orifice through which product is dispensed upon head reciprocation. More particularly, the invention relates to a protector cap telescoped over the plunger head, normally covering the discharge orifice during non-use, and automatically uncovering the orifice prior to manual reciprocation of the head.

Manually actuated dispensers, such as pump dispensers and aerosols, are known for dispensing a variety of products upon finger actuation of a plunger head or spray button for effecting discharge of product through the spray orifice. The sprayed products may include hair sprays and other resinous containing materials which, upon drying, on exposure to the atmosphere, tend to clog the spray discharge orifice. Clogging interferes with the free flow of discharge by causing sputtering and uneven spray patterns.

Protector caps and covers have been devised to prevent the drying out of the discharged material in the discharge spout or orifice and to prevent its contamination. The known caps and covers employed for this purpose are, however, rather cumbersome, difficult to operate, costly to fabricate and somewhat ineffective. Moreover, they are so structured as to render them unwieldy and unattractive.

U.S. Pat. No. 3,254,677 discloses a resilient closure device mounted on the spray button of an aerosol dispenser to render the dispenser self sealing. The closure device is substantially U-shaped in cross-section having a pair of spaced arms. One of the arms seals off the discharge orifice from the atmophere in the normal position of the closure relative to the spray button. Such one arm has an aperture which is brought into registry with the discharge orifice upon manual application of a downward force on the closure.

The spray button has outwardly diverging grooves at the front face and at the back face thereof. In mounting, the arms of the closure are spread apart so that the ends of the arms fit into such grooves and are locked into place. Upon downwardly pressing the closure, the diverging surfaces on the spray button spread the arms apart and further distend the closure. At the same time the aperture in the front arm of the closure is brought into registry with the discharge orifice. When the closure bottoms out on the spray button, further downward movement of the closure serves to move the spray button downwardly while spraying through the uncovered orifice. Upon release of finger pressure applied to the closure, the closure springs upwardly relative to the spray button due to the resiliency from which the closure is made.

The drawbacks of such a closure or protective cap for a spray button are that the spray button must be specially designed as having front and back diverging grooves which renders the assembly more costly and difficult to produce and more cumbersome to operate. Moreover, the inherent resiliency of the spring legs of the closure must be relied upon to return the closure to its upper position of non-use each time finger force is removed therefrom. Since the closure is of a plastic material, it is known that this inherent resiliency or memory fails at some juncture after repeated use, such that the closure will not positively return to its upper position of non-use as intended. Also, each of the outwardly diverging grooves must be of a sufficiently steep angle to assure spring contraction of the closure arms to a less distended position during the upward return movement of the closure. However, because of space limitations of aerosol spray buttons which are typically quite small, steep angular grooves are not made possible.

SUMMARY OF THE INVENTION

It is therefore an object of the present invention to avoid the noted problems of the prior art by the provision of a protector cap for the discharge orifice of a manually reciprocable plunger head or button, the cap being adapted for use with a standard plunger head or button without the need for special molding or design thereof as in the prior art. Moreover, the protector cap of the invention more positively responds under spring action upon removal of finger force applied thereto without relying on the spring memory of the cap itself as required in the art.

In accordance with the invention, the protector cap is telescoped over the plunger head for reciprocation independent thereof along the head axis. A portion of the cap side wall covers the discharge orifice in a condition of non-use, and the cap has an aperture adjacent such wall portion for alignment with the orifice for uncovering the orifice in a condition of use. A spring extends only between the plunger head top wall and the cap top wall for resiliently urging the cap into its condition of non-use. The cap is axially moveable relative to the head between the non-use and use conditions upon application of finger force applied to the cap in the direction of head reciprocation for covering and uncovering the orifice.

The spring acting between the top walls of the plunger head and the protector cap may comprise a spring formed integrally with the top wall of the protector cap. Otherwise, such spring may comprise a separate spring such as a helical coil spring or the like.

Other objects, advantages and novel features of the invention will become more apparent from the following detailed description of the invention when taken into conjunction with the accompanying drawings.

DETAILED DESCRIPTION OF THE INVENTION

Figure 1:
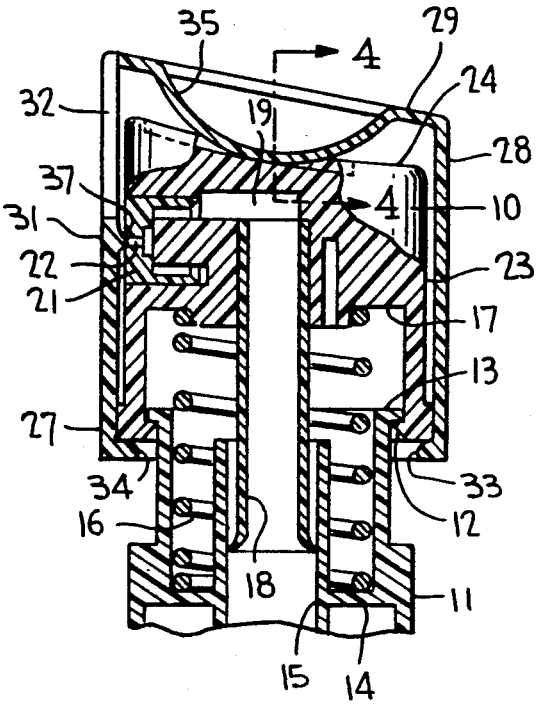
FIG. 1 is a vertical sectional view of a known fingertip sprayer having a protector cap and wiper thereon according to the invention, the cap being shown in a position of non-use.

Turning now to the drawings wherein like reference characters refer to like and corresponding parts throughout the several views, a plunger head 10 for a finger actuated sprayer is shown in FIG. 1 which is typically mounted on a dispenser body 11, retention beads 12, 13 respectively on the head in the body cooperating in a known manner to prevent separation of the parts. The body has an upper transverse wall 14 supporting a fixed cylinder 15 in communication with a valved inlet (not shown) from which a dip tube (not shown) extends into the product within the container (not shown) to which body 11 is mounted as in a known manner.

A plunger return spring 16 extends between wall 14 and an undersurface 17 of the head, and a hollow piston 18 depends from the head for reciprocation within the pump cylinder. A discharge passage 19 communicates with the hollow piston, and a discharge valve cup 21 is mounted within the head in communication with the discharge passage. The discharge passage terminates in a discharge orifice 22 located in the valve cup. Thus, upon manual reciprocation of the plunger head along its central axis, product is discharged during each compression stroke through the discharge orifice, as known in the art.

Although a fingertip pump dispenser is described, the present invention is not limited for use with such a pump dispenser, but is likewise made adaptable for use with an aerosol sprayer as well. Such an aerosol sprayer has a plunger head or an aerosol button 10 as it is sometimes called together with other parts similar to that aforedescribed except for a piston and cylinder. The dip tube extends into the product within the container which includes a gaseous propellent, as well known in the art.

Figure 3:
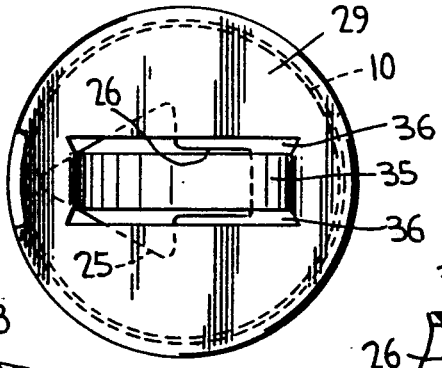
FIG. 3 is a top plan view of the overcap of FIG. 1.

The plunger head is of normal shape and construction in that it has a generally cylindrical side wall 23 and a top wall 24 having a depression in which the operator's finger is nested. The top wall likewise has a directional arrow 25 (FIG. 3) formed as a depression in top wall 24, the arrow pointing in the direction of the discharge orifice to orient the operator to the direction of discharge. This depression is shown at 26 in FIG. 4.

A protector cap 27 of the invention overlies the plunger head in telescoping relationship. The cap has a cylindrical side wall 28 and a top wall 29 forming a bearing surface for the finger of the operator. A side wall portion 31 of the cap covers the discharge orifice in the non-use condition of FIG. 1. And, the cap side wall has an aperture 32 adjacent wall portion 31 which is placed into alignment with the discharge orifice in the condition of use of FIG. 2 as will be described in more detail hereinafter.

In the non-use condition of FIG. 1, top wall 29 of the cap is spaced from top wall 24 of the plunger, and spring means extends only between such walls for resiliently urging the cap into its FIG. 1 condition of non-use. The lower end of the cap may have an annular, inwardly directed bead 33, interrupted or uninterrupted, engaging lower edge 34 of the plunger head for locking the cap to the head.

Figure 4:
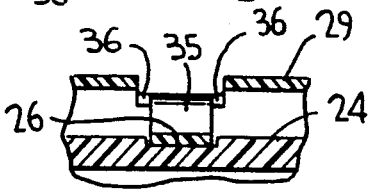
FIG. 4 is a sectional view taken substantially along the line 4—4 of FIG. 1.

The spring means acting between top walls 24 and 29 may be in the form of a bow spring 35 integral with top wall 29 of the cap and formed during the cap molding opeation. The bow spring, which may be arcuate in shape, is separated from the remainder of the top wall 29 of the cap by transverse slits 36 (FIG. 3), the spring bearing against top wall 24 of the plunger head, or extending slightly into depression 26 thereon, as shown in FIG. 4. The bow spring may be of a slightly flatter profile compared to that shown in FIG. 1 such that a portion thereof will engage the side walls of depression 26 of the directional arrow, or the directional arrow may be sized so that the bow spring will engage the side walls of depression 26 when in the non-use condition of FIG. 1. In such manner, any rotation of the cap relative to the plunger head will be avoided such that aperture 32 will be oriented directly above the discharge orifice to ensure an uncovering of the orifice when the cap is lowered relative to the head. Certainly, other measures may be taken to avoid relative rotation between the cap and the head, without departing from the invention. Or, aperture 32 may be of a sufficient width (in a circumferential direction of cap wall 28) such that even if the overcap is rotated relative to the head the aperture will be placed in registry with the orifice upon depression of the cap into the use condition of FIG. 2.

Figure 2:
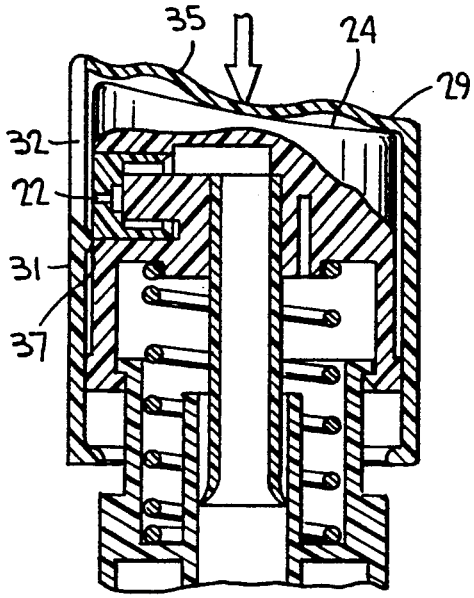
FIG. 2 is a view similar to FIG. 1 with the cap being shown in a condition of use.

In operation, application of finger force against top wall 29 of the cap, in the direction of the arrow of FIG. 2, axially shifts the cap, independently of plunger head, from its FIG. 1 to its FIG. 2 position. The cap, when so depressed, axially shifts against the bias of bow spring 35 which typically bends into a complex curve as shown in FIG. 2. Aperture 32 is thus brought into alignment with discharge orifice 22 for thereby uncovering the orifice. Continued application of the finger force applied to the cap, in the direction of plunger reciprocation, depresses the plunger head (or spray button) to effect a spray discharge of product through the uncovered discharge orifice and the aligned aperture 31, as shown in FIG. 2. The plunger head is depressed against the action of its return spring as in any normal manner.

When the desired amount of product has been dispensed upon each pressure stroke of the plunger, the applied finger force is removed, allowing the plunger to return to the upwardly extended position of FIG. 1, as assisted by return spring 16, as known in the art. Removal of the applied finger force automatically returns the protector cap to its FIG. 1 position from that of FIG. 2 as resiliently urged by the unbending of bow spring 35 into its orifice-covering position of FIG. 1.

The spring force of bow spring 35 must be less than the spring force of return spring 16 to effect lost motion between cap depression and plunger depression to assure an uncovering of the orifice before the plunger is stroked. This relative spring force may be such that bow spring 35 will bend to a lesser extent than shown in FIG. 2 before the plunger head is lowered, such that cap top wall 29 need not abut against head top wall 24 before the head is depressed, contrary to that shown in FIG. 2. In any event, the bent bow spring will resume its essentially unbent condition of FIG. 1 upon release of finger pressure applied to the cap, such that wall portion 31 will again cover the discharge opening when returned to the FIG. 1 position for thereby closing the orifice to the atmophere which avoids possible clogging of discharge passage 19 and of discharge orifice 22 during especially prolonged periods of non-use of the dispenser. Such prolonged exposure to air would otherwise adversely affect the qualitive discharge or other physical characteristics.

In accordance with another feature of the invention, any accumulation of the dried product at or in the discharge orifice is removed and is further prevented by the provision of a small projection 37 on the inner surface of wall portion 31 of the cap. As shown in FIG. 1, this projection is in alignment with the discharge orifice and may slightly project into the orifice in the orifice-covering position. Upon downward axial movement of the cap to the FIG. 2 position, the projection simply wipes the orifice and its vicinity clean while removing any dried product as may have accumulated.

Figure 5:
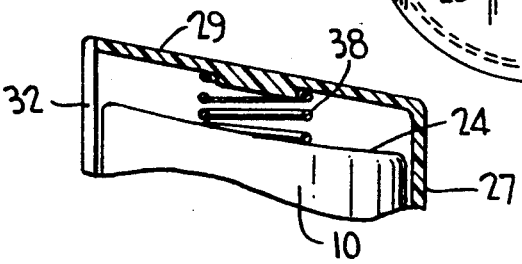
FIG. 5 is a partial vertical sectional view similar to that of FIG. 5 showing a separate spring acting between the plunger top wall and the protector cap top wall.

Other spring means extending between head top wall 24 and cap top wall 29 for resiliently urging the cap into its FIG. 1 condition of non-use, can be provided without departing from the invention. For example, a separate helical coil spring 38 shown in FIG. 5 may be provided between walls 29 and 24 and attached to one of the walls. Again, the force of spring 38 must be less than the spring force of return spring 16 in order to permit lost motion between the depressed cap prior to a lowering of the plunger head as aforedescribed. Other types of springs extending between walls 24 and 29 may likewise be provided, within the spirit of the invention.

From the foregoing it can be seen that the protector cap and wiper of the invention is adapted for use with a standard plunger head or a standard aerosol button without the need to modify the plunger head or button as in the prior art. And, a positive spring action is provided between walls 24 and 29 which does not rely on spring legs which must be distended as in the prior art and which tend to lose their spring memory and fail in effecting the necessary return of the cap from its use condition to its condition of non-use. Such failure would simply render the dispenser useless.

Obviously, many other modifications and variations of the present invention are made possible in the light of the teachings. It is therefore to be understood that within the scope of the appended claims the invention may be practice otherwise than as specifically described.

What is claimed is:

1. A manually operated dispenser having a plunger head reciprocable along a central axis thereof, said head having a smooth cylindrical side wall and a top wall, said side wall containing a discharge orifice through which product is expelled upon head reciprocation, a protector cap mounted on said plunger head for reciprocation independent thereof along sad axis, said cap having a cylindrical side wall telescoped over said head side wall, said cap having a top wall overlying said head top wall and being spaced therefrom in a condition of non-use, a portion of said cap side wall covering said orifice in said condition of non-use, said cap side wall having an aperture adjacent said wall portion for alignment with said orifice for uncovering said orifice in a condition of use, said cap top wall having an integral bow spring bearing against said head top wall for spacing said top walls apart for thereby resiliently urging said cap into said condition of non-use, said cap being axially moveable relative to said head into said condition of and use upon application of finger force to said cap top wall overcoming the spring force of said bow spring in the direction of head reciprocation for uncovering said orifice, said bow spring urging said cap into said condition of non-use upon removal of the applied finger force.

2. The dispenser according to claim 1, wherein stop means acting between said plunger and said cap are provided for limiting said cap to said condition of non-use under the bias of said spring means.

3. The dispenser according to claim 1, wherein said cap side wall has an internal projection partially extending into said orifice in said condition of non-use for wiping the orifice clean of any accumulated dried product from the orifice upon the axial movement of said cap.

4. The dispenser according to claim 1, further having a return spring biasing said plunger head into a return position upon said reciprocation, said return spring having a predetermined spring force, and said spring means having a spring force less than said predetermined force, whereby the axial movement of said cap is effected before plunger reciprocation.

* * * * *